US005716021A

United States Patent [19]

Tournebize et al.

[11] Patent Number: 5,716,021

[45] Date of Patent: Feb. 10, 1998

[54] AUTOMATIC UNLOADING OF A CUTTING MACHINE

[75] Inventors: Thierry Tournebize, Givry; André Robert Martin, Chalon sur Saône, both of France

[73] Assignee: Eastman Kodak Company, Rochester, N.Y.

[21] Appl. No.: 669,019

[22] Filed: Jun. 24, 1996

[30] Foreign Application Priority Data

Jul. 13, 1995 [FR] France ..... 95 08768

[51] Int. Cl.[6] ..... B65H 19/30

[52] U.S. Cl. ..... 242/530.1; 242/533.2; 242/533.7

[58] Field of Search ..... 242/530.1, 530.3, 242/533.2, 533.7, 533.8

[56] References Cited

U.S. PATENT DOCUMENTS

| | | | |
|---|---|---|---|
| 2,327,906 | 8/1943 | Kiefer | 242/533.7 |
| 2,579,700 | 12/1951 | Picton | 242/530.1 |
| 3,718,302 | 2/1973 | Mount et al. | 242/533.7 |
| 3,779,475 | 12/1973 | Plevin | 242/533.2 |
| 4,055,313 | 10/1977 | Yamaguchi et al. | 242/530.4 |
| 4,208,019 | 6/1980 | Dusenbery | 242/530.4 |
| 5,042,272 | 8/1991 | Furr | 242/533.2 |
| 5,136,859 | 8/1992 | Nitta | 242/533.2 |

*Primary Examiner*—John M. Jillions
*Attorney, Agent, or Firm*—Mark G. Bocchetti

[57] ABSTRACT

An apparatus and method for automatically unloading narrow rolls of web formed by a cutting machine while preserving the order in which the narrow rolls of web were formed. The apparatus includes a feed station, a winding station, a cutting station and an unloading station. The feed station distributes a sheet of product in strip form with a relatively large width to the cutting station in which the sheet is split so as to form several narrow strips of web. The winding station includes at least two winding mechanisms on each side of the sheet to wind each narrow strip of web onto a core. The winding shafts are movable from the winding station to the unloading station so that other winding shafts can be moved to and used in the winding station. The rolls of strip product on the winding shaft are transferred to respective reception shafts in the unloading station, the winding shafts and reception shafts generally aligning with one another in the unloading station such that there respective cantilevered, free ends reside adjacent one another.

12 Claims, 3 Drawing Sheets

AUTOMATIC UNLOADING OF A CUTTING MACHINE

The invention relates to the cutting of a product in strip form taking the form of a sheet so as to obtain a large number of narrow strips, and more particularly to the unloading of these machines once the cutting to shape has taken place.

Cutting machines are well known in the art. When a sheet of product in strip form is to be split, the strip is reeled off in a cutting station, and then each strip is wound onto a respective core in a winding station. When the cutting machine splits the sheet into several narrower strips, the winding station is provided with two drive shafts operating simultaneously so as to separate the plane of the wound strips spatially and thus avoid damage to the edges of these strips through friction between them.

Furthermore, it is particularly advantageous to be able to unload the rolls of strips formed during the operation of the cutting machine and the formation of new rolls. To this end, the number of winding shafts in the winding station is doubled and, while a set of shafts serves to wind the cut product, the product already cut and wound on the other set of shafts can be manipulated so as to unload the products manufactured and prepare the winding shafts for their subsequent use when the products being wound on the other set of shafts are of the required size.

The machines that are available commercially generally have two turrets each provided with two drive shafts. When the wound coils have large diameters, the vertical stacking of the four drive shafts necessitates a considerable height and the manufacturers of these machines have proposed to offset the position of the drive shafts horizontally so as to reduce the vertical dimensions.

In this type of machine, unloading the products wound onto the shaft consists of bringing one of the shafts on which the products in strip form are wound and a device for holding said wound strips or cradle into precise register, holding said wound strips, then removing the drive shaft through translation parallel to its axis. The drive shaft and device for holding the strips in place can be brought into register either by moving the holding device or by moving the shaft. Where the holding device is moved, a station for bringing into register must be provided for each of the winding shafts, thereby increasing the cost of the machines. Furthermore, the space available between the various winding shafts is relatively limited. Where the drive shaft is moved, the heavy load generated by the volume of the product wound on each shaft requires very robust mechanisms. Furthermore, winding shafts are relatively complex mechanical components, and handling them increases the risk that they will be damaged.

Cutting machines are known in which the winding shafts are held so as to project at one of their ends. After the desired quantity of strip has been wound onto the cores carried by the winding shafts, the latter are rotated about a practically vertical axis situated in the vicinity of the end serving to keep it projecting so as to move it away from the winding station and dispose it in an unloading station. The winding station being freed, it can be loaded with two other winding shafts onto which the machine winds the strips while the other winding shafts are unloaded in the winding station. Advantageously, the cutting machine is provided with two winding mechanisms disposed on each side of the path followed by the sheet to be split, and each mechanism comprises two winding shafts held by this mechanism so as to project. The latter embodiment eliminates the need to manipulate and move the winding shafts, thereby avoiding any risk of damage.

The invention proposes to produce an automatic unloading device which preserves the sequencing of the strips throughout its operation.

The invention also proposes to dispose automatically on the winding shafts the empty cores designed to receive narrow strips.

To this end, the machine able to use the invention must comprise a feed station for distributing a sheet of product in strip form which has a relatively large width, a cutting station in which said sheet is split so as to form several narrow strips, a winding station comprising at least two winding mechanisms disposed on each side of the sheet and serving to wind each narrow strip onto a core being rotated, each mechanism being provided with at least two winding shafts and each winding shalt having a rotation axis situated in a practically horizontal plane and being disposed so as to project, and an unloading station in which the winding shafts are distant from the winding station and placed in the unloading station so as to be able to introduce other winding shafts into said winding station in order for them to be used, while affording access to the free end of the winding shafts situated in the unloading station so that the rolls of product in strip form carried by said winding shaft situated in the unloading station can be extracted by means of this free end.

The invention therefore provides a device for arranging, automatically and in overlapping time, in cradles, narrow rolls of strip formed by a cutting machine for a product in strip form, while preserving the order in which they were formed by the cutting machine.

The device in accordance with the invention is characterized in that it comprises: a) first means for holding at least one reception shaft so that it projects in a substantially horizontal plane; b) second means for mutually aligning the free ends of the projecting reception shaft and of any one of said projecting winding shafts when they are disposed in the unloading station; c) third means for transporting, on the reception shaft aligned with the corresponding winding shaft, all the rolls situated on said winding shaft; d) fourth means for moving the free ends of said reception shaft and said winding shaft away from each other; e) fifth means for moving said reception shaft and said cradle into register with respect to each other so that said cradle supports said narrow rolls of strip; f) sixth means for moving said reception shaft and all the narrow rolls of strip with respect to each other in a direction parallel to the longitudinal axis of said reception shaft, and thereby separating said reception shaft and said set of rolls from each other.

The invention also provides a method characterized in that: a) after at least one of said winding shafts has been tilted from the winding station to the unloading station, the narrow rolls of strip disposed on this winding shaft are slid onto a reception shaft kept in a substantially horizontal plane, projecting at one of its ends and aligned with said winding shaft; b) said reception shaft is moved about a vertical axis so as to move all the narrow rolls of strip away from the winding station and dispose them in the reception station; c) the rolls of product in strip form are deposited on a cradle; d) said reception shaft is moved in translation along its longitudinal axis so as to move it away from said narrow rolls of strip.

In an improved method of the invention, after the reception shaft has been separated from the narrow rolls of strip, the cradle is moved away from the reception station, a new cradle carrying empty cores is introduced into the reception station, said reception shaft is moved in translation along its longitudinal axis so as to be introduced into the cores, the cradle and the reception shaft are moved apart from each other vertically, the reception shaft and whichever of the winding shafts is empty are aligned with each other and all the cores disposed on the reception shaft are slid onto the winding shaft with which they are aligned.

Other advantages will appear through a reading of the description that follows, made with reference to the accompanying drawing given solely by way of example, in which.

Figure 1:
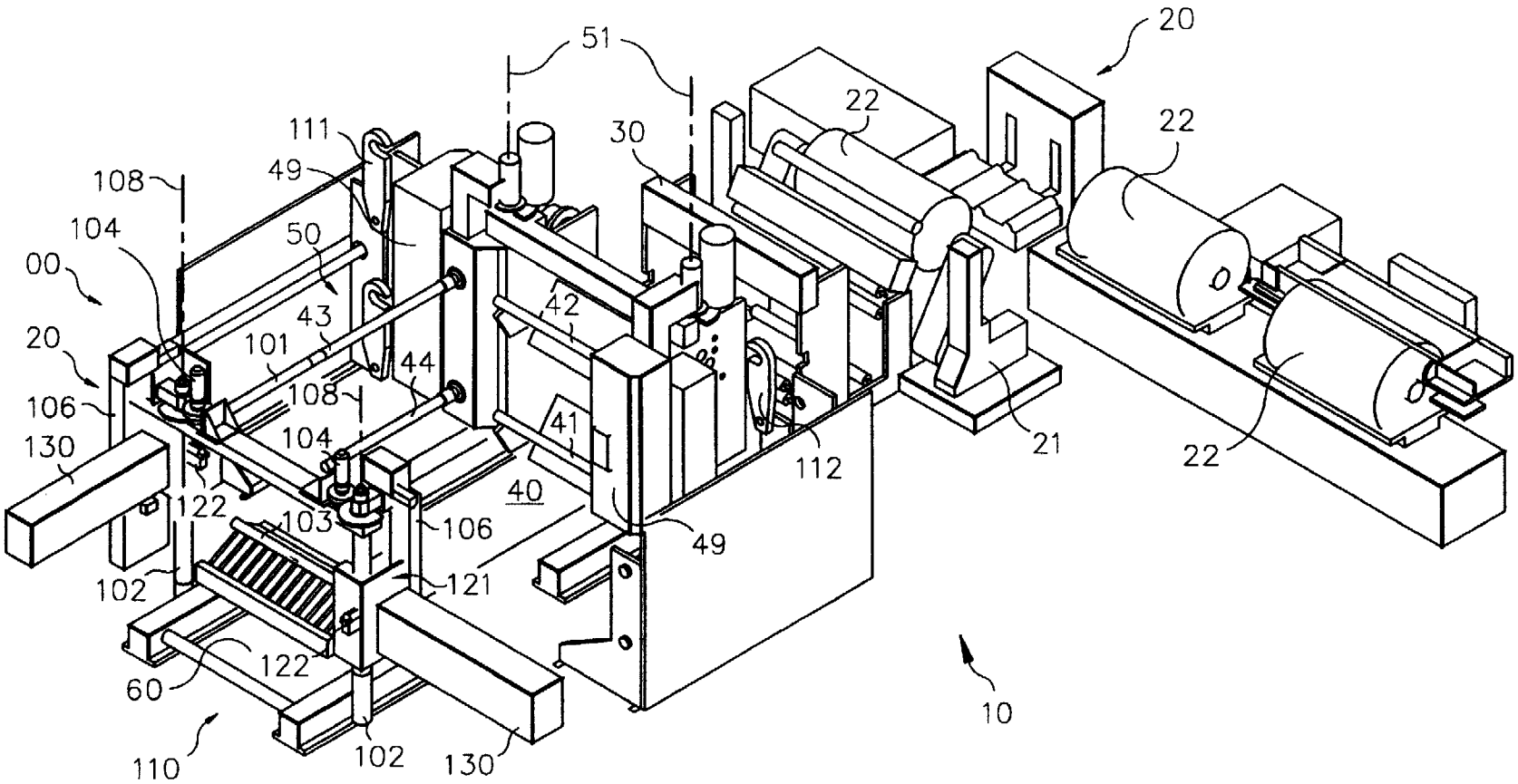
FIG. 1 depicts diagrammatically a cutting machine associated with an unloading device in accordance with the invention.

As can be seen in FIG. 1, the cutting machine 10 comprises a feed station 20, a cutting station 30, a winding station 40 and an unloading station 50.

The feed station 20 comprises a system for bringing to the unwinding mechanism 21 rolls 22 of large-size product in strip form. The product in strip form is unwound so as to form a relatively wide sheet. The usual width of the sheet is around 1.40 m; but it is evident that different widths of sheet can be used. Advantageously, the width of the sheet is disposed in a practically horizontal plane. The sheet of product in strip form is sent to a cutting station 30.

As is well known in the art, the cutting station 30 comprises essentially knives and bedknives for splitting the sheet into a multitude of narrow individual strips. The strips can be of various sizes. Generally in photography, the width of the strips is 35 mm or 16 mm. However, it is obvious that strips of different widths can be produced. When magnetic products are produced, it is usual to cut strips 3.81 mm wide. In order to avoid damage to the edges of strips obtained by splitting the wide sheet, the neighboring strips are made to diverge and directed towards a winding station 40.

The winding station 40 is provided with at least two cantilevered winding shafts 41, 42 whose axes are situated in practically horizontal planes.

Advantageously, in order to permit unloading whilst the cutting machine is in operation, the winding station of the cutting machine is provided with two winding mechanisms 49, one mechanism on each side of the sheet.

The device according to the invention can be used in cutting machines in which the winding shafts are disposed so as to project. Advantageously, in cutting machines able to be used with the invention, the winding shafts are disposed in the unloading station 50 by rotating said shafts about a practically vertical axis 51 disposed in the vicinity of whichever of the ends of the winding shaft is not the free end.

As is well known in the art, there are disposed on each winding shaft cores surrounding this winding shalt and on which an individual strip is attached. Each winding shaft is rotated and is arranged, as is well known, in such a way as to rotate the cores, so as to form narrow rolls of strip. Once the rolls have been formed, the sheet is cut. The winding shafts are then moved away from the winding station and disposed in the unloading station. The narrow rolls of product in strip form are then extracted at the free end of the winding shafts and disposed in cradles 60 which hold said rolls in position. Advantageously, the size of the cores along their axis is approximately twice the width of the cut strips. In this way, it is not necessary to provide spacers between the cores when they are disposed on the winding shafts. Furthermore, the cores project beyond the faces of the narrow rolls of strip and can serve to hold said rolls in position. In order to benefit from all the advantages of the invention, the axes of the winding shafts of each winding mechanism 49 are situated in the same vertical plane. Furthermore, the rotation of the winding shafts about the vertical axis is through 90°. In this way, the winding shafts are parallel to the principal direction of the path followed by the sheet and leave the winding station clear to a significant extent. It is evident that the angle of rotation of each of the mechanisms 49 is so arranged as to bring the free end of the winding shafts into a position distant from the cutting machine, opposite the unloading device, which will now be described.

The unloading device 100 according to the invention preferably comprises two unloading mechanisms 120, 121, each provided with a reception shaft, 101, 103 respectively, held so as to project in a practically horizontal plane by a frame 102. It is evident that it is possible to use only a single unloading mechanism 120 so long as the frame 102 is made mobile, which complicates the unloading device. Advantageously, in accordance with the invention, one of the unloading mechanisms 120 enables the reception shaft 103 to be disposed opposite one or other of the winding shafts 41, 42 when the latter are disposed in the unloading station. The other unloading mechanism 120 disposes the other reception shaft 101 opposite the winding shafts 43, 44. It is evident that the movement of the reception shaft can be replaced by a corresponding movement of the winding shafts. In accordance with the invention, the winding shafts 41, 42, and 43, 44 respectively are disposed in the same vertical plane and the vertical movement of the reception shaft, respectively 103, 101, is effected for example by an endless screw 106 rotated in one direction or the other by a motor.

When the reception shaft 101 is aligned with one of the winding shafts, a pushing device, respectively 112, 111, surrounds the corresponding winding shaft and then moves parallel to said winding shaft so as to transport onto the reception shaft, respectively 101, 103, all the rolls situated on said winding shaft.

The unloading device 100 also comprises means such as, for example, a motor 104 for turning said reception shaft about a practically vertical axis 108. In this way, the free ends of the reception shaft and winding shalt are moved away from each other. It is evident that other types of means, able to work for example in translation, can be used. In one advantageous embodiment of the invention, the rotation of the reception shaft and the rotation of the winding shafts are identical to each other and through 90°. This arrangement enables the sequencing of the rolls to be preserved whether they are unloaded with one of the mechanisms 49 or the other. It is evident that other arrangements can be used, such as that depicted in FIG. 11.

The unloading device 100 comprises a reception station 110 in which the cradles 60 arranged so as to receive and hold in position the narrow rolls of strip are disposed one by one, preferably automatically. When the reception shaft supporting a set of rolls is disposed in the reception station in register with an empty cradle 60 also disposed in the reception station, said reception shaft and said cradle are moved with respect to each other so that the cradle supports each of said rolls. In the preferred embodiment, the reception shaft is lowered so as to cause the part of the cores projecting from the wound strip to rest on said cradle. When the cradle is supporting the rolls a member 130 moves the reception shaft along its axis so as to separate said reception shaft from all the rolls which are held by the cradle. The cradle can then be used to transport the rolls of strips to another work station, dispose another empty cradle in position and unload the second winding shaft by carrying out the operations described above.

The various phases in the operation of the device in accordance with the invention are shown diagrammatically in FIGS. 2 to 10, which depict only a part of the cycle and which will be discussed in detail hereinafter.

Figure 2:
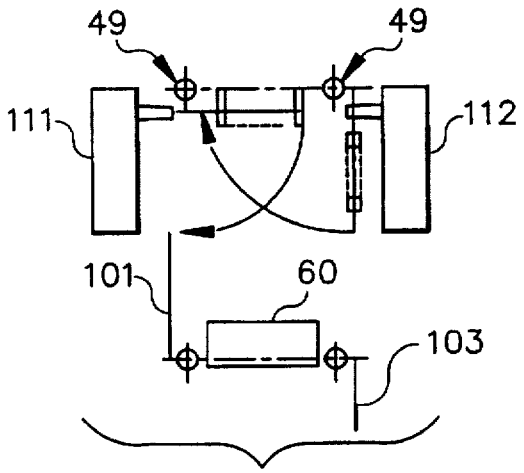
FIGS. 2 to 10 depict diagrammatically the various phases in the operation of the device in accordance with the invention.
Figure 3:
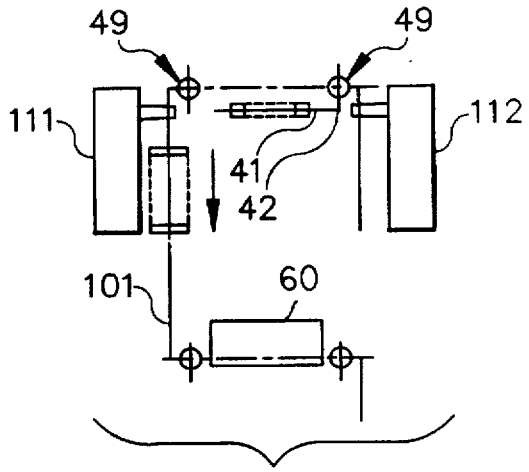

FIG. 2 depicts the machine at the moment a predetermined length of strip has been stored on the cores carried by the winding shafts 43 and 44 for example, and the narrow strips have been separated from the wide sheet. At this moment, as can be seen in FIG. 3, the winding mechanisms 49 are pivoted so as to dispose the shafts 43 and 44 in the unloading station and the shafts 41 and 42 (provided with empty cores) in the winding station.

Figure 4:
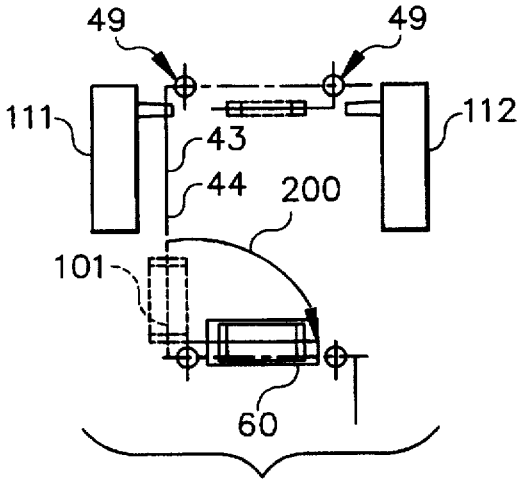
Figure 5:
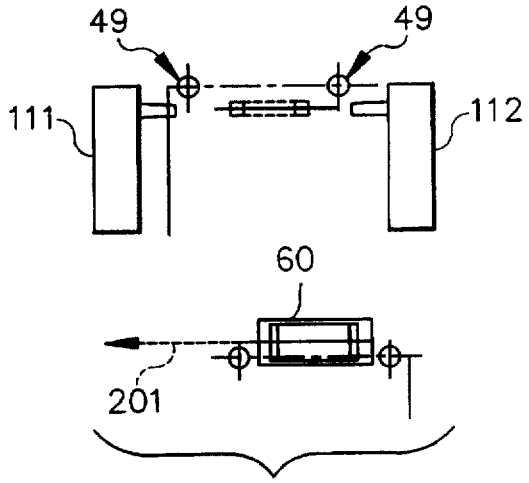
Figure 6:
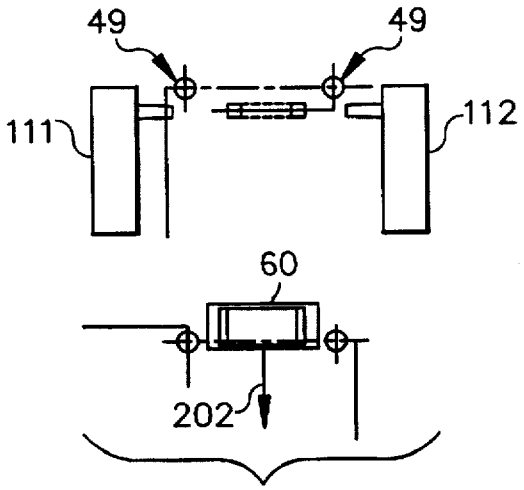
Figure 7:
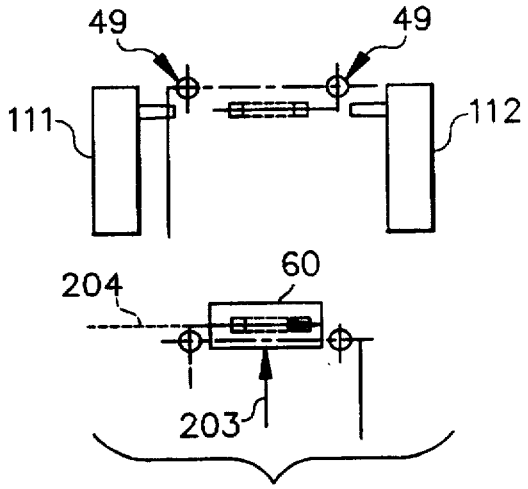
Figure 8:
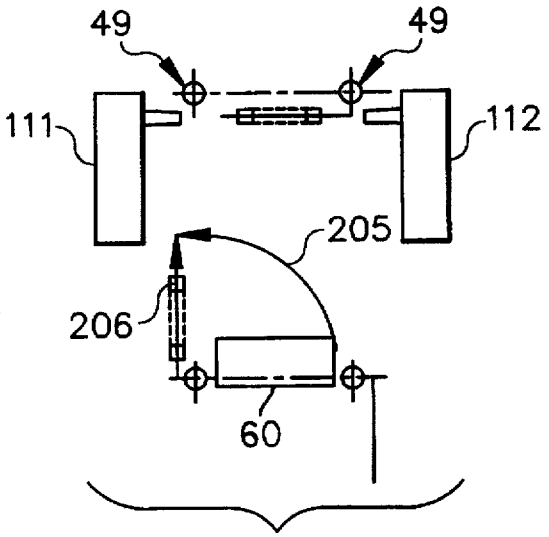
Figure 9:
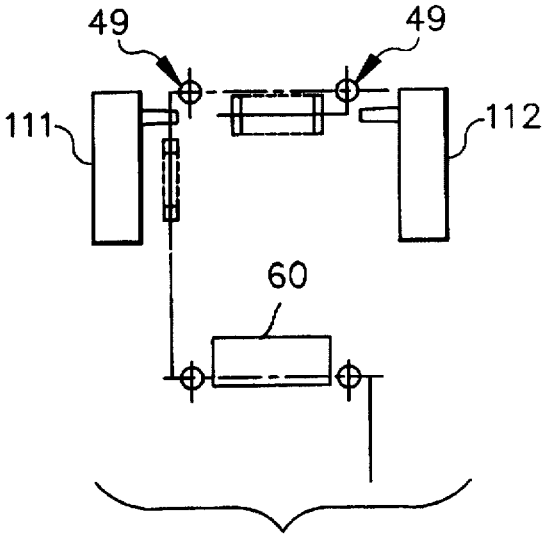

The automatic unloading operation can then commence. The reception shaft 101 is placed in register with one of the winding shafts, 43 for example, and all the rolls carried by the shaft 43 are transferred to the reception shaft 101 by means of a pushing device 111, and then this reception shaft is pivoted as indicated in FIG. 4 by the arrow 200 so as to place the cradle 60 and all the rolls in register. The reception shaft 101 is lowered so as to deposit the rolls in the cradle, and then, as indicated in FIG. 5 by the arrow 201, the reception shaft 101 is moved in translation along its longitudinal axis. Once the shaft has been moved away from the rolls the cradle carrying the rolls is moved away as indicated by the arrow 202 in FIG. 6. A new cradle, which can advantageously be provided with empty cores onto which strips will subsequently be wound, is disposed in the reception station, as indicated by the arrow 203 in FIG. 7. The cores are introduced onto the reception shaft by moving line 204 the reception shaft 101 along its longitudinal axis. As indicated by the arrow 205 in FIG. 8, the reception shaft 101 is pivoted so as to align it with the shaft 43, and the cores are transferred onto this winding shaft, to be used subsequently.

Once the winding shaft 43 has been unloaded and then reloaded with empty cores, the reception shaft 101 is aligned with the winding shaft 44 (which, in FIGS. 2 to 10, is superimposed on the winding shaft 43).

Figure 10:
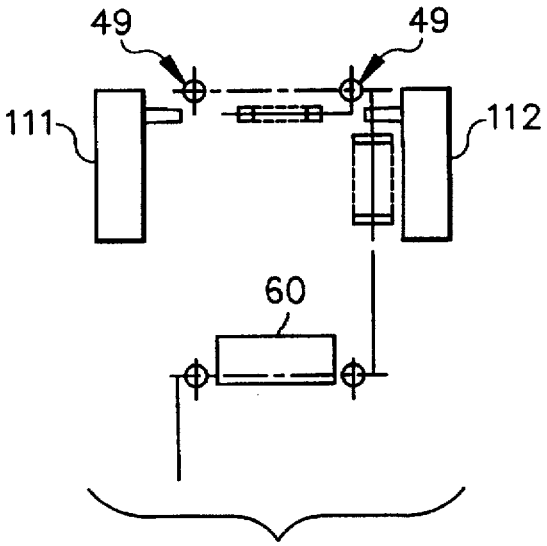

The operations indicated above with reference to FIGS. 3 to 9 are repeated so as to unload the shalt 44 and reload it with empty cores. When the length of strip wound onto the cores in the winding station is attained, and the strips have been separated from the sheet of product, the winding shafts 41 and 42 are pivoted from the winding station to the unloading station, and the winding shafts 43 and 44 provided with their empty cores are pivoted from the unloading station to the winding station as depicted in FIG. 10. The winding shafts 41 and 42 are then unloaded in a similar way to the previous description given with reference to FIGS. 3 to 9.

Figure 11:
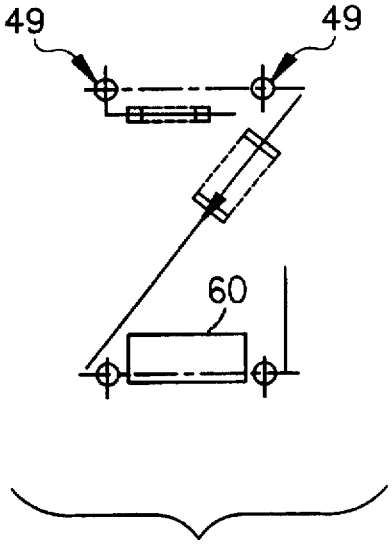
FIG. 11 depicts diagrammatically another embodiment of the device in accordance with the invention.

It is evident that another embodiment could be contemplated wherein the sequence depicted by FIGS. 2 to 10 is slightly modified. As depicted in FIG. 11, instead of aligning a winding shaft with a reception shaft along an edge of a rectangle, alignment could be obtained along a diagonal of the reception.

It is evident that, in order to enable the various elements to be placed in register, all the movements can be obtained using motors acting on axes coded so that their position can be determined precisely. Such systems enable the elements to be positioned with a level of precision better than 0.1 mm.

All the narrow rolls of strip together constitute a heavy weight. When the reception shaft of one of the unloading mechanisms receives all the rolls carried by one of the winding shafts, the weight of these rolls causes it to flex. The following step of the operation moves the reception shaft about a vertical axis so as to bring it into register with a cradle disposed in the reception station. This movement also brings the reception shaft opposite the other unloading mechanism. In order to avoid oversizing the reception shaft, while retaining a sufficiently precise register of the rolls with respect to the cradle, a stop 122 is provided on each of the unloading mechanisms 120.

An appropriate controlled vertical movement of the two unloading mechanisms enables the free end of the reception shaft to be rested on the stop carried by the other reception mechanism so as to take the load off the shaft and give it a horizontal position. The two unloading mechanisms can then be moved downwards synchronously in order to deposit the narrow rolls of strip on the cradle. It is evident that this can be achieved only by coding all the movement mechanisms.

Advantageously, the stop can be arranged so that it serves to keep the empty cores disposed in the cradles in position in order for them to be mounted on the winding shafts. It is evident that the reception shaft must have a slightly smaller diameter than the diameter of the winding shafts. Furthermore, the alignment of the reception shaft with the corresponding winding shafts is brought about by the alignment of the top lines of the reception shaft and the corresponding winding shaft.

10 cutting machine
20 Feed station
21 Unwinding mechanism
22 Rolls
30 Cutting station
40 Winding station
41 Winding shaft
42 Winding shaft
43 Winding shaft
44 Winding shaft
49 Winding mechanisms
50 Unloading station
51 Vertical axis
60 Cradles
100 Unloading device
101 Reception shaft
102 Frame
103 Reception shaft
104 Motor
106 Endless screw
108 Vertical axis
110 Reception station
111 Pushing device
112 Pushing device
120 Unloading mechanism
121 Unloading mechanism
122 Stop
130 Member
200 Arrow
201 Arrow
202 Arrow
203 Arrow
204 Arrow
205 Arrow
206 Arrow

What is claimed is:

1. A device for arranging, automatically and in overlapping time, in cradles, narrow rolls of strip formed by a cutting machine for a product in strip form, while preserving the order in which they were formed by the cutting machine, which comprises a feed station for distributing a sheet of product in strip form which has a relatively large width, a cutting station in which said sheet is split so as to form several narrow strips, a winding station comprising at least two winding mechanisms disposed on each side of the sheet and serving to wind each narrow strip onto a core being rotated, each mechanism being provided with at least two cantilevered winding shafts and each winding shaft presenting a free end and having a rotation axis situated in a generally horizontal plane, and an unloading station in which the winding shafts, when placed in the unloading station, are distant from the winding station so as to be able to introduce other winding shafts into said winding station in order for them to be used, while affording access to the free end of the winding shafts situated in the unloading station so that the rolls of product in strip form carded by said winding shaft situated in the unloading station can be extracted by means of this free end, the device being characterized in that it comprises:

first means for holding at least one cantilevered reception shaft having a free end so that it projects in a substantially horizontal plane;

second means for mutually aligning the free ends of the projecting reception shaft and of any one of said cantilevered winding shafts when they are disposed in the unloading station;

third means for transporting, on the reception shaft aligned with the corresponding winding shaft, all the rolls situated on said winding shaft;

fourth means for moving the free ends of said reception shaft and said winding shaft away from each other;

fifth means for moving said reception shaft and said cradle into register with respect to each other so that said cradle supports said narrow rolls of strip;

sixth means for moving said reception shaft and all the narrow rolls of strip with respect to each other in a direction parallel to the longitudinal axis of said reception shaft, and thereby separating said reception shaft and said set of rolls from each other.

2. A device according to claim 1 further comprising means for moving said at least one reception shaft vertically so that said at least one reception shaft can be aligned with any one of the winding shafts.

3. A device according to claim 1 further comprising drive means for revolving said at least one reception shaft about a generally vertical axis.

4. A device according to claim 1 wherein at least one reception shaft is lowered in order to deposit the narrow rolls of strip on said cradle.

5. A device according to claim 1 wherein said at least one reception slides along a respective longitudinal axis.

6. A device according to claim 1 further comprising a pushing device able to surround any one of the winding shafts, said pushing device being movable parallel to the rotation axis of the winding shaft so as to move all the narrow rolls of strip carried by the winding shaft.

7. A device according to claim 1, comprising two mutually independent reception shafts.

8. A device according to claim 7 wherein said at least two winding shafts and said two reception shafts are disposed at a respective comer of a rectangle and are pivotable about a respective substantially vertical axis to thereby reside on either of two sides of the rectangle adjacent the respective coRNer.

9. A device according to claim 7 wherein said at least two winding shafts are disposed at a respective corner of a first side of a rectangle and are pivotable about a respective vertical axis to thereby reside on either of said first side and a respective diagonal of said rectangle and wherein said two reception shafts are disposed at a respective corner of a second side of said rectangle, said second side being parallel to said first side, and are pivotable about a respective vertical axis to thereby reside on either of said second side and respective diagonal of said rectangle said reception shafts, when residing in the reception station, can take a position parallel to a relative position of winding shafts when said at least two winding shafts are in the winding station.

10. A method for unloading rolls of strip wound on cores in a winding station while preserving the order in which the rolls were formed, the winding station including at least two generally horizontal, cantilevered winding shafts, said method comprising the steps of:

(a) moving at least one of the at least two generally horizontal, cantilevered winding shafts from the winding station to the unloading station, the at least one of the at least two generally horizontal, cantilevered winding shafts having a plurality of rolls of strip supported thereon;

(b) aligning in the unloading station the at least one of the at least two generally horizontal, cantilevered winding shafts with at least one cantilevered reception shaft;

(c) transferring the plurality of rolls of strip from the at least one of the at least two generally horizontal, cantilevered winding shafts to the at least one cantilevered reception shaft positioned in an unloading station such that the at least one cantilevered reception shaft is inserted through each of the cores of the rolls;

(d) pivoting the at least one cantilevered reception shaft about a vertical axis to move the at least one cantilevered reception shaft away from the unloading station;

(e) supporting the plurality of rolls of strip on at least one cradle in a reception station; and (f) translating the at least one cantilevered reception shaft along a longitudinal axis thereof to thereby remove the at least one cantilevered reception shaft from the cores of the rolls.

11. A method as recited in claim 10 further comprising the steps of:

(a) moving the at least one cradle with the plurality of rolls of strip supported thereon away from the reception station;

(b) moving an additional at least one cradle to the reception station;

(c) supporting a plurality of empty cores on the additional at least one cradle;

(d) translating the at least one cantilevered reception shaft along the longitudinal axis thereof to thereby insert the at least one cantilevered reception shaft into the plurality of empty cores supported on the additional at least one cradle;

(e) pivoting the at least one cantilevered reception shaft about the vertical axis to thereby remove the plurality of empty cores from the additional at least one cradle and move the at least one cantilevered reception shaft with the plurality of empty core supported thereon to the unloading station;

(f) aligning the at least one cantilevered reception shaft with the at least one of the at least two generally horizontal, cantilevered winding shafts which has been unloaded during said transferring step;

(g) transporting the plurality of empty cores on the at least one cantilevered reception shaft to the at least one of the at least two generally horizontal, cantilevered winding shafts; and (h) pivoting the at least one of the at least two generally horizontal, cantilevered winding shafts with the plurality of empty cores supported thereon back to the winding station.

12. A method as recited in claim 11 further comprising the step of:

winding a strip on each of the plurality of empty cores supported on the at least one of the at least two generally horizontal, cantilevered winding shafts to form another plurality of rolls.

* * * * *

UNITED STATES PATENT AND TRADEMARK OFFICE

CERTIFICATE OF CORRECTION

PATENT NO. : 5,716,021
DATED : 10 February 1998
INVENTOR(S) : Thierry Tournebize, et al It is certified that error appears in the above-identified patent and that said Letters Patent is hereby corrected as shown below:

Claim 1, Col. 7, Line 16 -- Please delete "carded" and replace with --carried--. --

Signed and Sealed this

Twenty-second Day of June, 1999

*Attest:*

*Attesting Officer*

Q. TODD DICKINSON

*Acting Commissioner of Patents and Trademarks*